US006257425B1

(12) United States Patent
Liu

(10) Patent No.: US 6,257,425 B1
(45) Date of Patent: Jul. 10, 2001

(54) COMBINATIVE DEVICE FOR CLOTHES SHELF AND TOWEL RACK

(75) Inventor: Chao-Min Liu, Sanchung (TW)

(73) Assignee: New Hung Kuan Enterprise Co., Ltd., Sanchung (TW)

( * ) Notice: Subject to any disclaimer, the term of this patent is extended or adjusted under 35 U.S.C. 154(b) by 0 days.

(21) Appl. No.: 09/537,556

(22) Filed: Mar. 30, 2000

(51) Int. Cl.[7] ..... A47K 10/00; A47F 5/08

(52) U.S. Cl. ..... 211/90.01; 211/88.04; 211/16; 211/105.1

(58) Field of Search ..... 211/90.01, 90.02, 211/88.04, 105.1, 94.01, 36, 6, 16, 43, 123, 175, 195; 108/42

(56) References Cited

U.S. PATENT DOCUMENTS 4,870,907 * 10/1989 McKee ..... 211/88.04 X 5,584,404 * 12/1996 Tsai ..... 211/94.01

* cited by examiner

*Primary Examiner*—Daniel P. Stodola
*Assistant Examiner*—Erica B Harris
(74) *Attorney, Agent, or Firm*—Bacon & Thomas, PLLC

(57) ABSTRACT

A combinative device for clothes and towel includes towel rack and clothes shelf; wherein the towel rack is formed by several rails mounted into a plurality of holes on two vertical supports and fixed with the corresponding plugs on the outwards of the support. A T-shaped flange is disposed on the upper side of the support with several aligned holes on the rear side of the support for securing onto the wall. The clothes shelf is composed of two rhombic bars formed by two pairs of L-shaped pieces with a slot on the lower end thereof for fitting onto the foregoing T-shaped flange of the support. Numerous cross rods are mounted between two rhombic bars for disposing a few plates thereon. According to the above-mentioned structure, the towel rack and clothes shelf can be assembled together in different ways or mounted respectively depending on the demand of the users.

1 Claim, 6 Drawing Sheets

COMBINATIVE DEVICE FOR CLOTHES SHELF AND TOWEL RACK

BACKGROUND OF THE INVENTION

1. Field of the Invention

The present invention relates to a combinative device which combines towel rack and clothes shelf. The clothes shelf is disposed on the support of the towel rack by rhombic bars. Both can be assembled together for use or detached depending on the need of users.

2. Description of the Prior Art

The conventional towel rack set in the bathroom, or the cabinet in washroom, or the shelf for holding clothes all has independent structure. Yet the space in the bathroom is usually quite restricted so that the space will be more limited and causes feelings of pressure when the towel rack and clothes shelf are arranged abreast.

Furthermore, if the towel rack and clothes shelf are disposed in a parallel direction, the clothes shelf usually occupies more space due to the heavier load so that the towel rack is mounted on the lower spot. Yet the lower location of the towel rack can cause inconvenience to users. On the contrary, if the position of the towel rack is adjusted to the higher place, the position of the clothes shelf will be too high to lay the clothes. Therefore, how to arrange the towel rack and clothes shelf well without causing inconvenience to users is a dilemma.

On the other hand, another kind of shelf with the towel rack for hanging towels below the clothes shelf, formed integrally with each other, can't be mounted respectively according to users' need and brings discomfort for users.

SUMMARY OF THE INVENTION

The primary object of the present invention is to provide a combinative device for towel rack and clothes shelf wherein the clothes shelf is combined with the support of the towel rack by rhombic bars. The combinative device can be used integrally or detached depending on the need of users.

The foregoing object and advantages of the present invention will be more apparent from the following detailed description, as taken in conjunction with the accompanying drawings wherein;

BRIEF OF THE DRAWINGS

DETAILED DESCRIPTION OF THE PREFERRED EMBODIMENT

Figure 1:
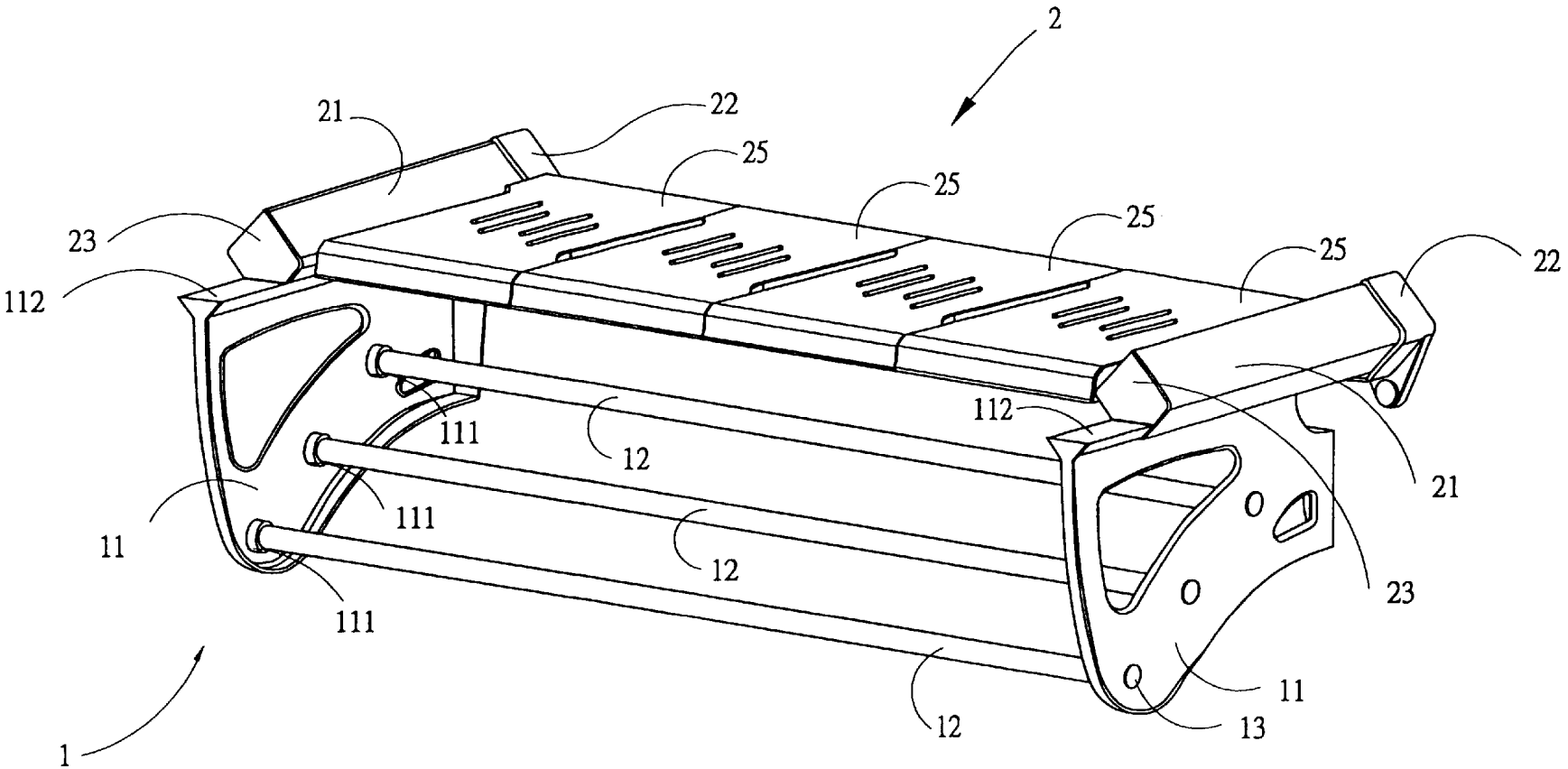
FIG. 1 is a perspective view of the present invention.
Figure 2:
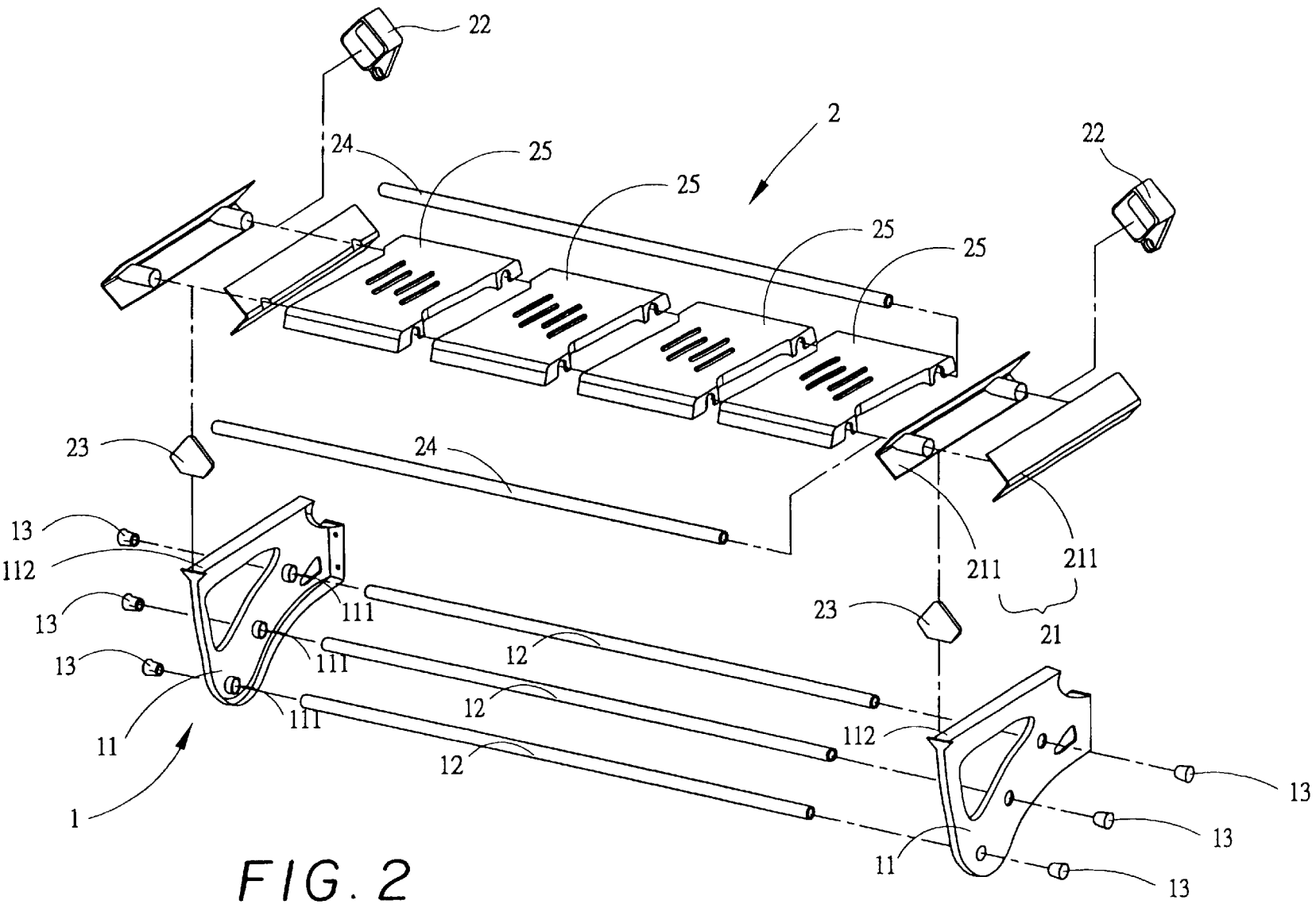
FIG. 2 is an exploded view of the present invention.

First, referring to the FIG. 1 and FIG. 2, the present invention comprises the towel rack 1 and the clothes shelf 2, the structure and the related position is described as following: the towel rack 1, having two vertical supports 11 with a plurality of corresponding holes 111 through which the rail 12 is inserted and fastened by the plug 13 outside thereof. The T-shaped flange 112 is fitted on the upper end of the support 11 with aligned holes on the rear side thereon for securing the support 11 onto the wall, as shown in FIG. 3.

Figure 4:
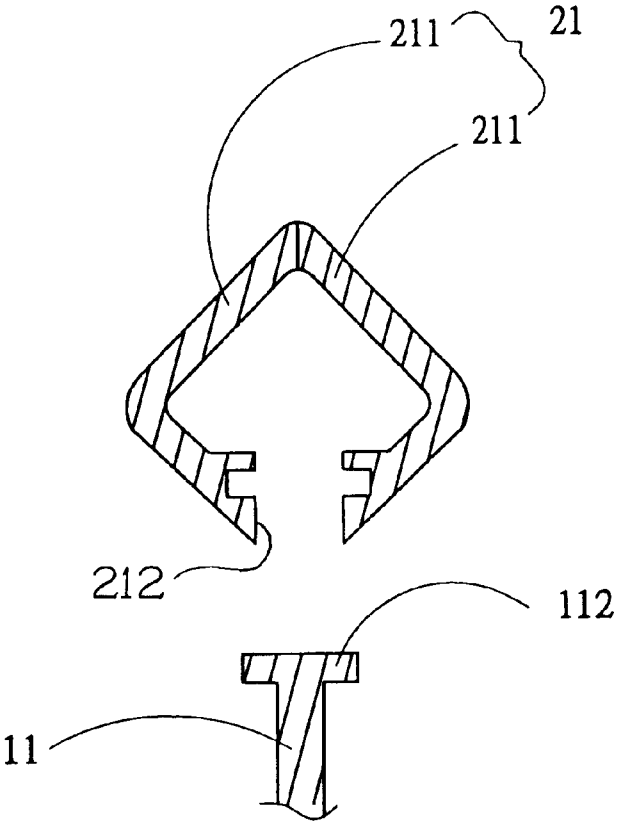
FIG. 4 is a cross-sectional of the rhombic bar.
Figure 5:
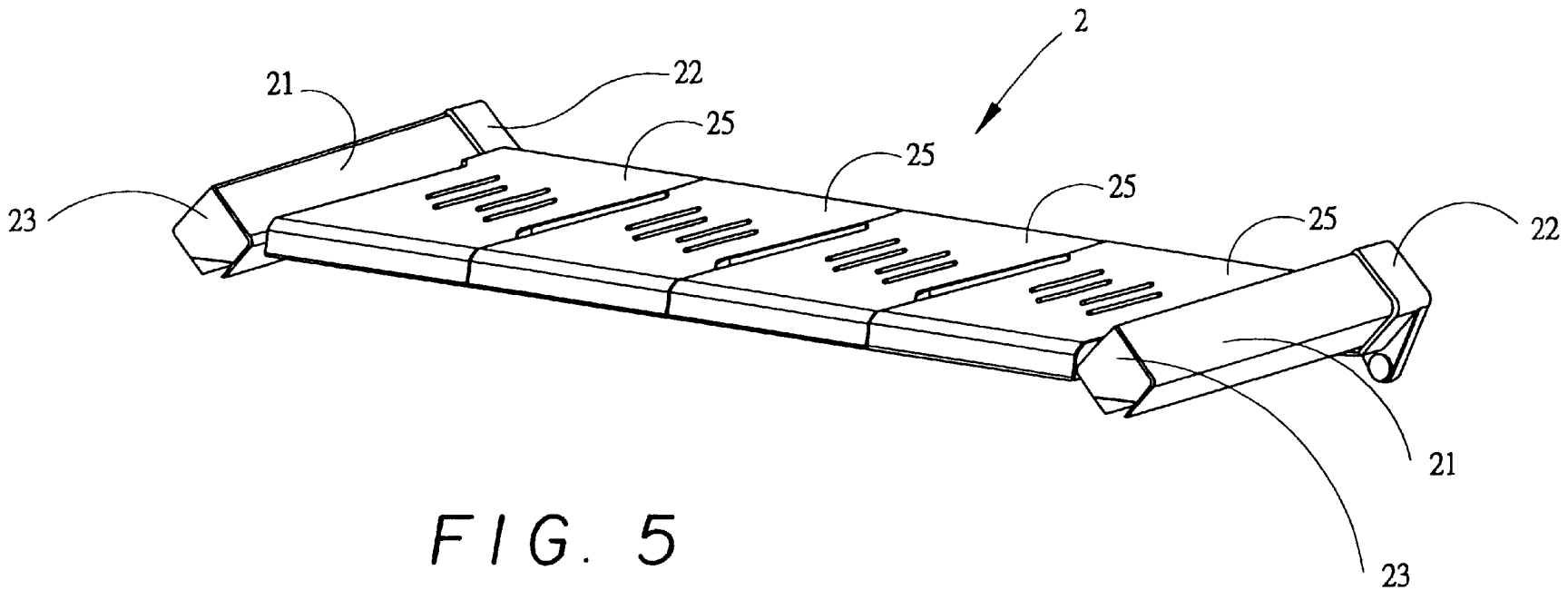
FIG. 5 is a perspective view of the clothes shelf of the present invention.

The clothes shelf 2 includes two rhombic bars 21 formed by two pairs of L-shaped pieces 211. A slot 212 is located on the lower end of the rhombic bars 21 for fitting onto the foregoing T-shaped flange 112 of the support 11, as shown in FIG. 4. A fixing seat 22 for fixing the clothes shelf 2 onto the wall, as shown in FIG. 5, is mounted on the rear end of the rhombic bars 21 and a cover 23 is arranged on the front end thereof. Several cross rods 24 are disposed between the two rhombic bars 21 with a number of plates 25 thereon.

According to the above structure, the clothes shelf 2 can be assembled above the towel rack 1 by the T-shaped flange 112 of the support 11 of the towel rack 1 inserting into the slot 212 of the two lateral rhombic bars 21 of the clothes shelf 2. So the towel rack 1 and the clothes shelf 2 are connected together and the occupied area of wall is reduced as well as the position is convenient for users to get the clothes or towel.

Figure 3:
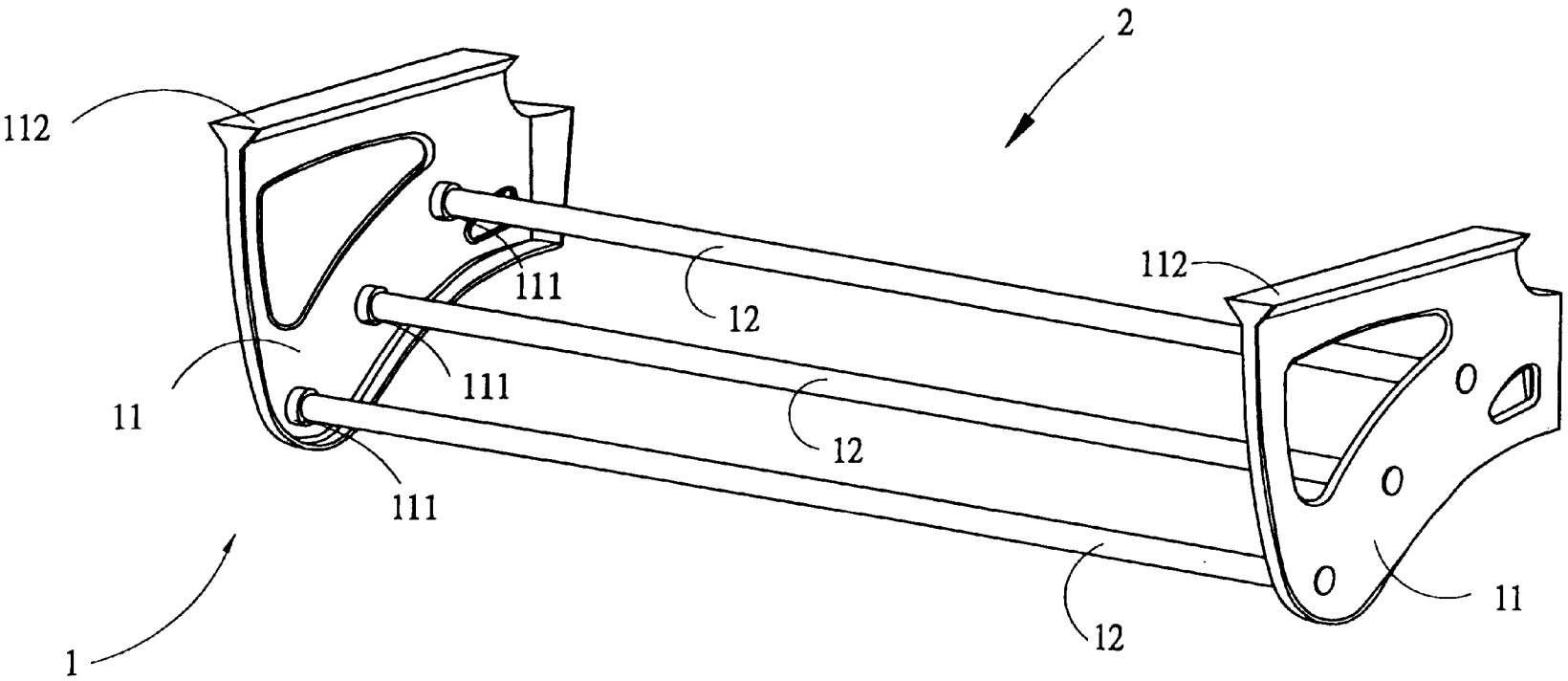
FIG. 3 is a perspective view of the towel rack of the present invention.

In addition, the clothes shelf 2 can be used independent without the towel rack 1 and both can be fixed onto the wall respectively, as shown in FIG. 3 and FIG. 5, according to the demand of users.

Figure 6:
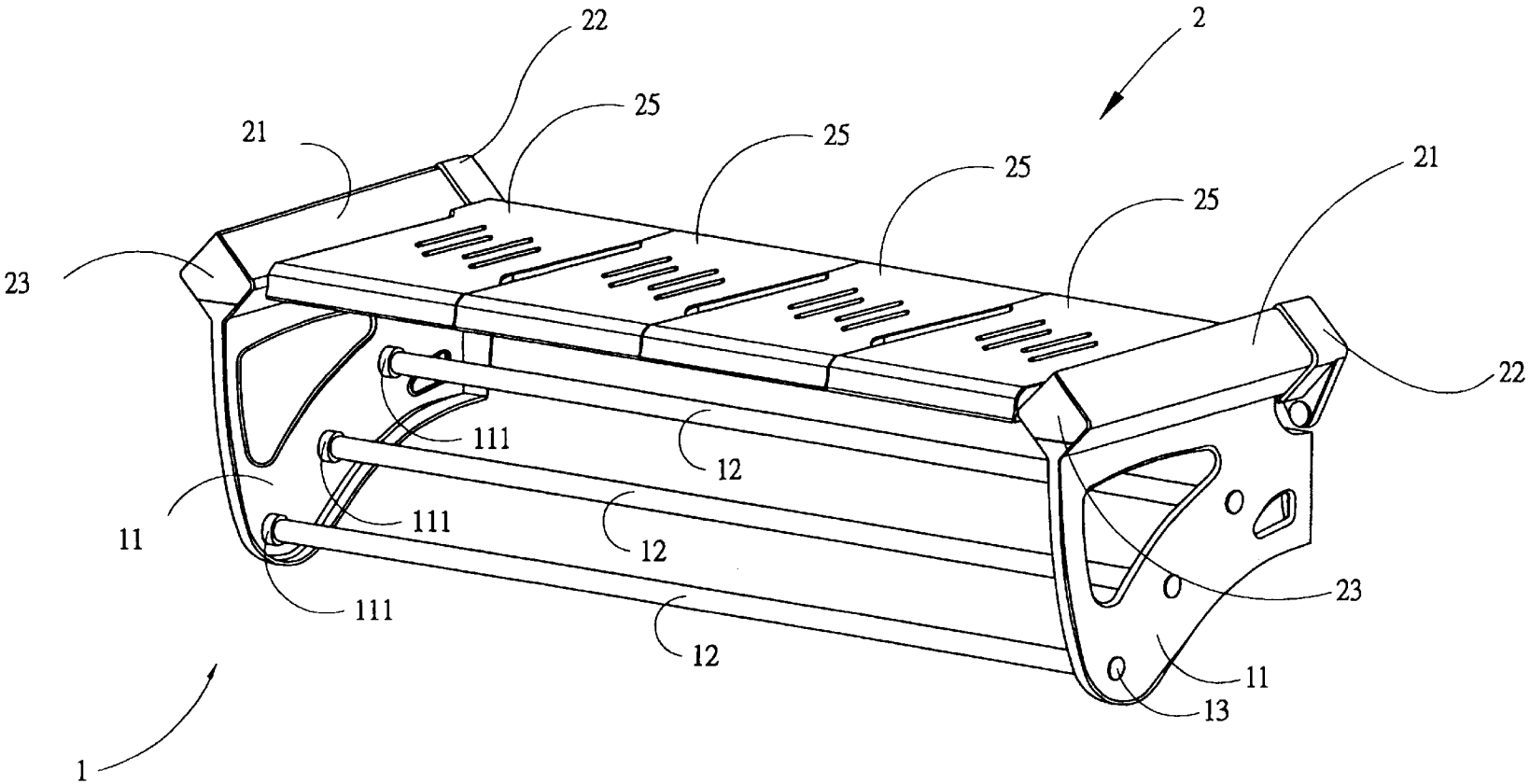
FIG. 6 is another embodiment of the present invention.

Referring to FIG. 6, the towel rack 1 is not necessary to be fixed on the wall. The towel rack 1 can be pulled forward from the lower part of the combinative device and this is another embodiment of the present invention.

Although the present invention has been described with respect to a preferred embodiment, it is contemplated that a variety of modifications, variations and substitutions may be done without departing from the scope of the present invention that is intended to be defined by the appended claim.

What is claimed is:

1. In combination, a towel rack comprising two vertical supports with a plurality of corresponding through holes defining respective pairs of through holes; a towel rail being fitted between each pair of through holes respectively; a fixing plug being inserted at an outer end of each said through hole of said supports; and a T-shaped flange located on the top of each said support, said supports being adapted to be fixed on a wall; and a clothes shelf comprising two rhombic bars; a plurality of cross rods; a plurality of horizontal boards, each said rhombic bar consisting of a pair of L-shaped pieces, a slot being formed at the bottom of each said rhombic bar receiving said T-shaped flange of said support; a fixing seat disposed at the rear end of each said rhombic bar; and a cover disposed at the front end thereof, said cross rods extending between said two rhombic bars, said horizontal boards being positioned upon said cross rods such that the clothes shelf can be fastened through said fixing seat onto the wall.

* * * * *